US005564865A

United States Patent [19]

Jansson

[11] Patent Number: 5,564,865

[45] Date of Patent: Oct. 15, 1996

[54] CONCRETE MODULE FOR RETAINING WALL AND IMPROVED RETAINING WALL

[76] Inventor: Jan E. Jansson, 814 S. Sierra Ave., Solana Beach, Calif. 92075

[21] Appl. No.: 169,600

[22] Filed: Dec. 17, 1993

[51] Int. Cl.[6] ..... F02D 29/02

[52] U.S. Cl. ..... 405/286; 405/284; 52/604; 52/606; 52/223.7

[58] Field of Search ..... 405/284, 285, 405/286; 52/603, 604, 606, 609, 223.6, 223.7, 223.9

[56] References Cited

U.S. PATENT DOCUMENTS

| | | | |
|---|---|---|---|
| 3,925,994 | 12/1975 | Broms et al. . | |
| 4,068,482 | 1/1978 | Hilfiker . | |
| 4,324,508 | 4/1982 | Hilfiker et al. . | |
| 4,379,659 | 4/1983 | Steiner . | |
| 4,470,728 | 9/1984 | Broadbeat . | |
| 4,592,678 | 6/1986 | McNinch et al. | 405/284 |
| 4,616,959 | 10/1986 | Hilfiker . | |
| 4,662,794 | 5/1987 | Delmas et al. . | |
| 4,671,706 | 6/1987 | Giardini . | |
| 4,802,320 | 2/1989 | Forsberg . | |
| 4,824,293 | 4/1989 | Brown et al. . | |
| 4,884,921 | 12/1989 | Smith . | |
| 4,920,712 | 5/1990 | Dean, Jr. . | |
| 4,964,761 | 10/1990 | Rossi . | |
| 5,007,218 | 4/1991 | Bengtson et al. | 52/223.7 X |
| 5,028,172 | 7/1991 | Wilson et al. . | |
| 5,066,169 | 11/1991 | Gavin et al. . | |
| 5,072,566 | 12/1991 | Zeidman . | |
| 5,108,231 | 4/1992 | Rausch . | |
| 5,177,925 | 1/1993 | Winkler et al. . | |
| 5,214,898 | 6/1993 | Beretta | 52/606 |
| 5,355,647 | 10/1994 | Johnson et al. | 52/223.7 X |

FOREIGN PATENT DOCUMENTS

| | | | |
|---|---|---|---|
| 2687707 | 8/1993 | France | 405/284 |
| 2537408 | 4/1976 | Germany . | |

OTHER PUBLICATIONS

"Loffelstein Engineering Manual", 1988.
Brochure, "Loffelstein Retaining Walls", 1988.

*Primary Examiner*—David J. Bagnell
*Assistant Examiner*—Frederick L. Lagman
*Attorney, Agent, or Firm*—Dressler, Goldsmith, Milnamow & Katz, Ltd.

[57] ABSTRACT

Concrete modules stacked in courses are used in making a retaining wall. Each module has unitary front, lateral, and bottom walls. The front wall may extend above the lateral walls. Each lateral wall has front ribs extending outwardly and inwardly and adjoining the front wall. Each lateral wall has back ribs extending outwardly and inwardly. In each intermediate course, the front and back ribs of each module partly support modules of the next course above and are partly supported by the front and back ribs of modules of the next course below. For post-tensioning of the retaining wall, plural elongate tensioning members are employed, each extending through an aperture of the bottom wall of one module of a lower course, between two modules of every other one of the intermediate courses, through an aperture of the wall of one module of an upper course. Geogrids can be positively and mechanically anchored to the retaining wall via battens retained by the inwardly extending back ribs of certain modules of selected courses.

24 Claims, 5 Drawing Sheets

FIG. 1
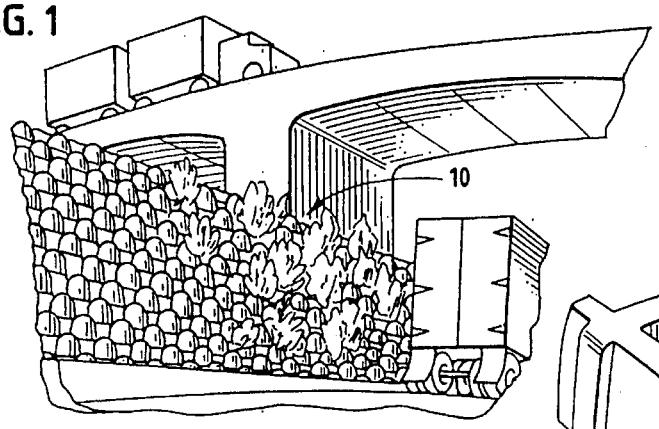
FIG. 2
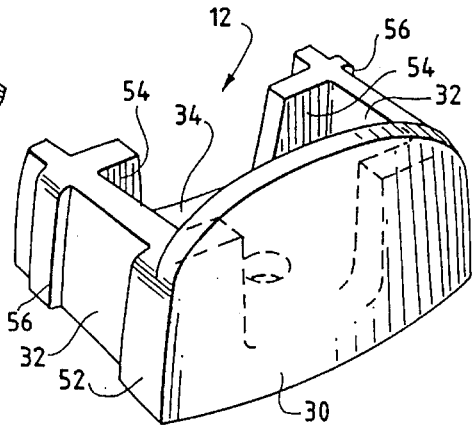
FIG. 4
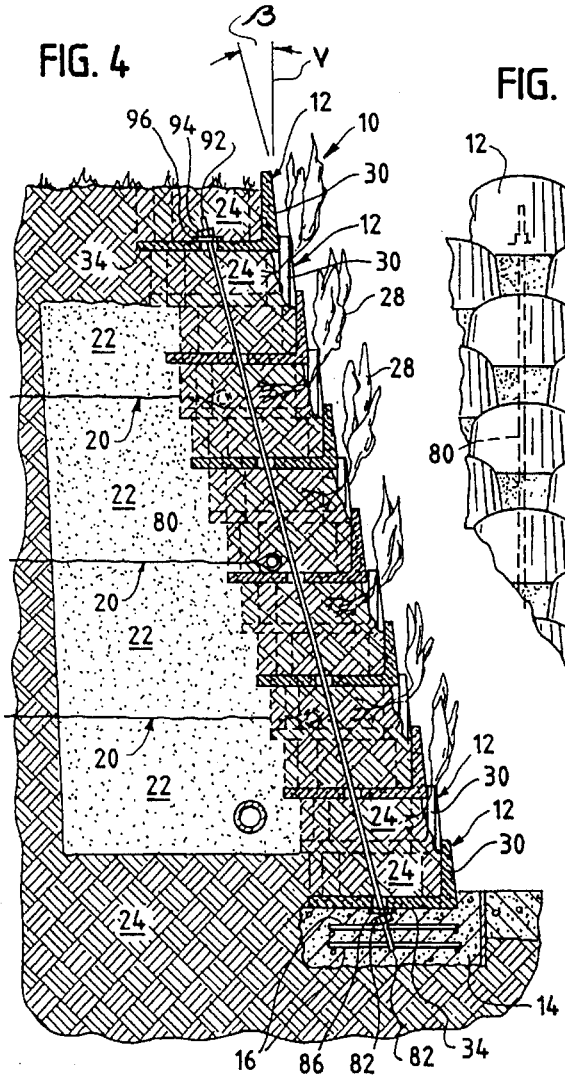
FIG. 3
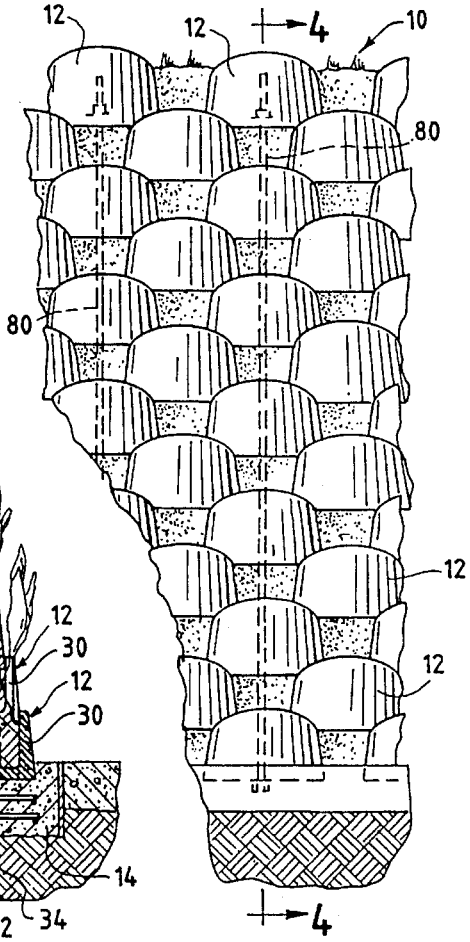
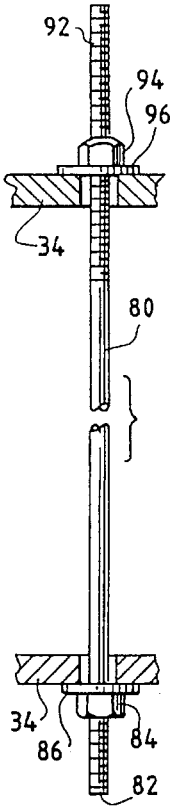
FIG. 5

CONCRETE MODULE FOR RETAINING WALL AND IMPROVED RETAINING WALL

TECHNICAL FIELD OF THE INVENTION

This invention pertains to an improved concrete module, which is useful in making a retaining wall. This invention also pertains to an improved retaining wall comprising concrete modules stacked in multiple courses, in which the modules of each intermediate course are straddled by modules of the next course above and by modules of the next course below.

BACKGROUND OF THE INVENTION

Retaining walls are used widely to construct soil embankments, sound barriers, and highway dividers, as well as for other similar and dissimilar purposes.

A retaining wall of a type in widespread use is made from concrete modules stacked in multiple courses. The modules are spaced laterally from one another in each course so that modules of each intermediate course are straddled by modules of the next course above and by modules of the next course below.

Since the modules are stacked so as to provide spaces therewithin and therebetween for plantable earth, a retaining wall of the type noted above is plantable. Vegetation planted in those spaces decorates the retaining wall and may help to anchor the modules.

Retaining walls of the type noted above and concrete modules therefor are exemplified in European Patent Application (Publication) No. 13,535, Steiner U.S. Pat. No. 4,379,659 and U.S. Pat. No. 4,521,138, Zeidman U.S. Pat. No. 5,072,566, Rausch U.S. Pat. No. 5,108,231, and Winkler et al. U.S. Pat. No. 5,177,925.

As exemplified in Swiss Patent No. 587,390 and corresponding German Published Patent Application (Offenlegungsschrift) No. 2,537,408, it is known for such a concrete module to have an open-topped, open-backed, trough-like configuration, which is defined by unitary front, lateral, and bottom walls. As illustrated and described therein, the front wall extends above the lateral walls and beyond the lateral walls on each side of the module, and the bottom wall is recessed upwardly from the lower edges of the front and lateral walls.

As a practical matter, the maximum height for a retaining wall built with such concrete modules, as described in the preceding paragraph, is limited by the columnar strength of the lateral walls of the modules. A maximum height of seven meters therefor is suggested by Winkler et al. U.S. Pat. No. 5,177,925, in column 1, lines 55 et seq. Such height limitations will be substantially more severe with curved (i.e., concave or convex) retaining walls.

As exemplified in Gavin U.S. Pat. No. 5,066,169, it is known to anchor a geogrid to concrete modules for a retaining wall, via retainer bars coacting with the geogrid and with integral bars on the modules.

Concrete modules of related interest, some having means for anchoring geogrids thereto, are exemplified in Broadbent U.S. Pat. No. 4,470,728, Giardini U.S. Pat. No. 4,671,706, Forsberg U.S. Pat. No. 4,914,876, Miner U.S. Pat. No. 4,936,714, Rossi U.S. Pat. No. 4,964,761, and Janopaul, Jr., U.S. Pat. No. 5,044,834.

Retaining walls of related interest, some employing geogrids, are exemplified in Broms et al. U.S. Pat. No. 3,925,994, Hilfilker U.S. Pat. No. 4,616,959, O'Neill U.S. Pat. No. 4,684,294, Brown U.S. Pat. No. 4,824,293, Wilson et al. U.S. Pat. No. 5,028,172, Risi et al. U.S. Pat. No. 5,064,313, and Strassil U.S. Pat. No. 5,108,232.

SUMMARY OF THE INVENTION

According to one aspect of this invention, an improved concrete module is provided, which is useful in making a retaining wall. The improved module has unitary walls including a front wall, which is upright, and two lateral walls, which also are upright. Each lateral wall has a front edge adjoining the front wall. The front wall may extend above the lateral walls. In one contemplated embodiment, each lateral wall has an upright, inwardly extending front rib adjoining the front wall along the front edge of each lateral wall. Also, each lateral wall may have an upright, outwardly extending front rib adjoining the front wall and aligned laterally with the upright, inwardly extending front rib of such lateral wall.

Preferably, the improved module may have an additional wall, which is unitary with the front and lateral walls. Preferably, moreover, the additional wall is a bottom wall. The bottom wall may have an aperture to accommodate an elongate tensioning member extending through the aperture.

In another contemplated embodiment, each lateral wall has an upright, inwardly extending back rib near a back edge of such lateral wall. Preferably, moreover, each lateral wall has an upright, outwardly extending back rib aligned laterally with the upright, inwardly extending back rib of such lateral wall.

According to another aspect of this invention, an improved retaining wall is provided. Generally, the retaining wall comprises concrete modules stacked in multiple courses including a lower course, at least one intermediate course, and an upper course. Each course has modules arranged so that modules of each intermediate course are straddled by modules of the next course above such intermediate course and by modules of the next course below such intermediate course. The modules of each course may be closely or widely spaced from one another or may abut one another.

Preferably, each module of the improved retaining wall conforms to the improved concrete module noted above, and the modules are stacked so that the rib or ribs of at least one of the lateral walls of each module of each intermediate or lower course support or supports one of the modules of the next course above such intermediate or lower course.

As one contemplated improvement, the improved retaining wall comprises means for post-tensioning the wall, the post-tensioning means including an elongate tensioning member extending from one of the modules in the lower course, between two of the modules in every other one of the intermediate courses, to one of the modules in the upper course. Preferably, each elongate tensioning member extends through an aperture in a bottom wall in one of the modules of the lower course, between two of the modules in every other one of the intermediate courses, through one of the modules in the upper course.

As another contemplated improvement, which contemplates that each lateral wall of each module has an inwardly extending back rib, the improved retaining wall further comprises a geogrid and means including a batten for anchoring the geogrid to a selected module. The batten is connected to the geogrid. The opposite ends of the batten are retained by the inwardly extending back ribs of the selected module, between those ribs and the front wall thereof, above the bottom wall thereof.

These and other objects, features, and advantages of this invention are evident from the following description of several contemplated embodiments of this invention with reference to the accompanying drawings.

BRIEF DESCRIPTION OF THE DRAWINGS

FIG. 1 is a fragmentary, perspective view of a retaining wall built from concrete modules, geogrids, and elongate tensioning members and filled with earth, which is planted with vegetation.

FIG. 2, on a larger scale compared to FIG. 1, is a perspective view of one concrete module used in the retaining wall of FIG. 1. The concrete module conforms to a first contemplated embodiment.

FIG. 3, on an intermediate scale compared to FIGS. 1 and 2, is a fragmentary, front elevation of the retaining wall. The vegetation is omitted to simplify the view.

FIG. 4 is a sectional view taken along line 4—4 of FIG. 3, in a direction indicated by arrows.

FIG. 5, on an enlarged scale, is a fragmentary detail of an elongate tensioning member, associated washers and threaded nuts, and two modules of the retaining wall.

DETAILED DESCRIPTION OF ILLUSTRATED EMBODIMENTS

Figure 6:
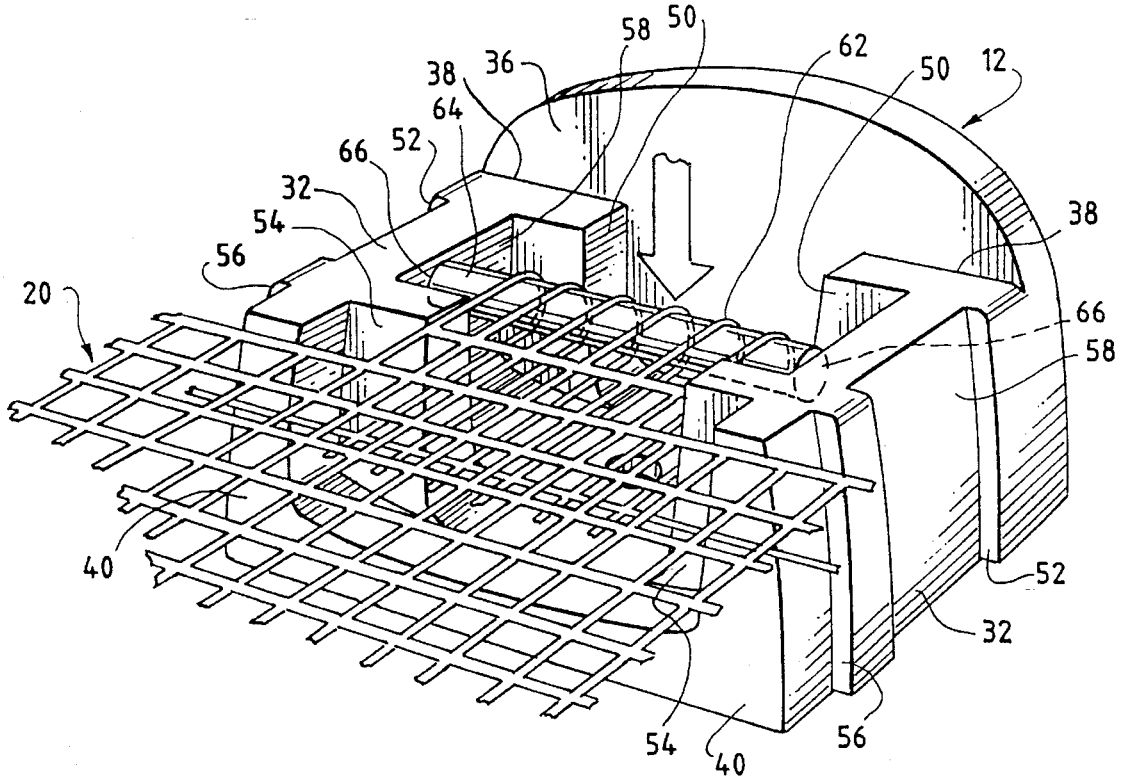
FIG. 6, on a similar scale, is a fragmentary, perspective view of a geogrid of a first known type being anchored to one of the concrete modules via a rigid, tubular batten, around which a portion of the geogrid is wrapped.

As shown in FIG. 1 and other views, a retaining wall 10 is built from concrete modules 12 stacked in multiple courses, in which the modules 12 are spaced laterally from one another so that modules 12 of each course straddle modules 12 of the next course above or below such course. Thus, the retaining wall 10 can provide plantable spaces within the modules 12 of each course and between the modules 12 of each course, whereby the retaining wall 10 is plantable. As shown in FIG. 4, the modules 12 in the lowermost course are supported by concrete footings 14, which have embedded reinforcing bars 16. Such footings are not necessary in a retaining wall.

Preferably, but not necessarily, the modules 12 are stacked in an odd number of courses. As shown in FIGS. 1, 3, and 4, the modules 12 are stacked in thirteen courses. Hereinafter, it is useful to refer to the lowermost course as the first course, to refer to the next course above the lowermost course as the second course, and so on through the thirteenth or uppermost course.

As shown in FIG. 4, the retaining wall 10 has three geogrids 20 anchored to certain of the modules 12 in a manner to be later described and anchored in fill, namely gravel 22 and earth 24, behind the retaining wall 10. Each geogrid 20 is anchored to some or all of the modules 12 in a selected course.

As shown in FIG. 4, a drainage pipe 26 is embedded in gravel 22, behind the modules 12 in the course above the lowermost course. Moreover, as shown in FIGS. 1 and 4, vegetation 28 planted in many of the spaces within and between the modules 12 decorates the retaining wall 10 and may help to anchor the modules 12.

As shown in FIGS. 2 and 6 and other views, each module 12 has an open-topped, open-backed, trough-like configuration, which is defined by a front wall 30, two lateral walls 32, and a bottom wall 34. The front wall 30 has an upper portion 36 extending above the lateral walls 32. Each lateral wall 32 has a front edge 38 adjoining the front wall 30 and a back edge 40 spaced from the front wall 30.

Each lateral wall 32 has an upright, inwardly extending front rib 50 adjoining the front wall 30 along the front edge 38 of such lateral wall 32. Also, each lateral wall 32 has an upright, outwardly extending front rib 52 adjoining the front wall 30 along the front edge 38 of such lateral wall 32 and aligned laterally with the rib 50 of such lateral wall 32.

Each lateral wall 32 has an upright, inwardly extending back rib 54 adjoining the front wall 30 near the back edge 30 of such lateral wall 32. Also, each lateral wall 32 has an upright, outwardly extending back rib 56 aligned laterally with the rib 54 of such lateral wall 32.

Each lateral wall 32 has a narrower, intermediate portion 58 between the front ribs 50, 52, of such lateral wall 32 and the back ribs 56, 58, thereof. The lateral walls 32 including the front ribs 50, 52, and the back ribs 54, 56, have coplanar top surfaces, above which the upper portion 26 of the lateral walls 32 extends. The front wall 30, the lateral walls 32 including the front ribs 50, 52, and the back ribs 54, 56, have coplanar bottom surfaces. The bottom wall 34 has a central aperture 60 for a purpose to be later described. As shown in FIGS. 2 and 6 and other views, the inwardly extending front ribs 50 are spaced laterally from each other so as to define a gap between such ribs 50, and the inwardly extending back ribs 54 are spaced laterally from each other so as to define a gap between such ribs 54. As further shown therein, the back ribs 54, 56, are substantially closer to the back edges 40 of the lateral walls 32 than to the front edges 38 of the lateral walls 32.

Figure 8:
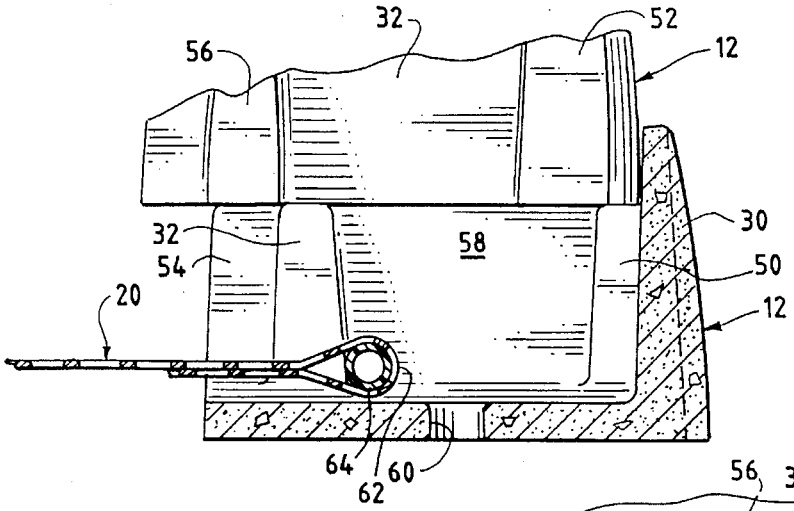
FIG. 8 is a fragmentary, sectional view taken through two of the concrete modules, one above the other, to which a geogrid of the first type is anchored via the rigid, tubular batten.
Figure 10:
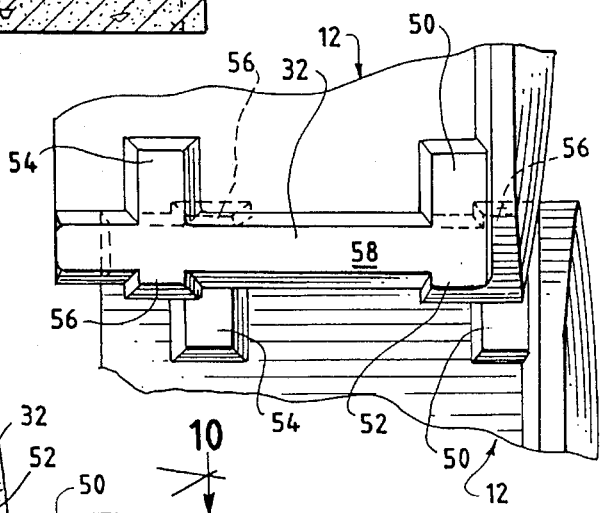
FIG. 10 is a fragmentary, sectional view taken along line 10—10 of FIG. 9, in a direction indicated by arrows.
Figure 9:
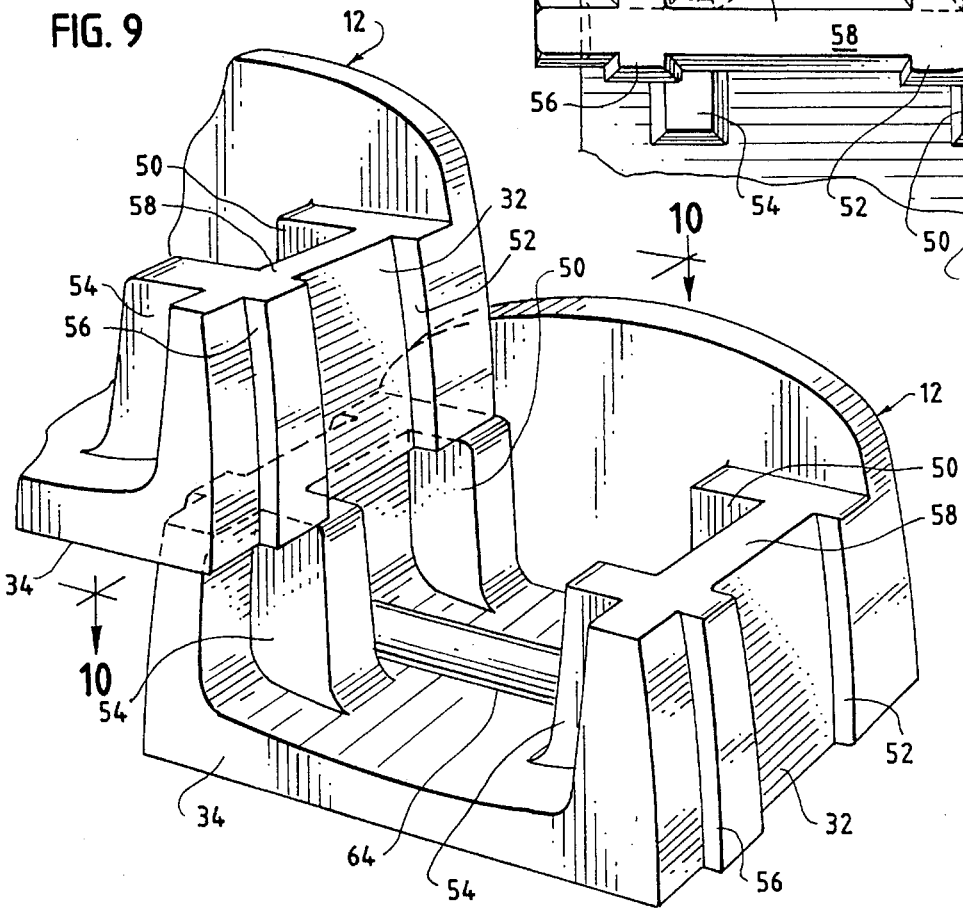
FIG. 9 is a fragmentary, perspective view of the same modules, the rigid, tubular batten being shown but the geogrid being omitted to simplify the view.
Figure 10A:
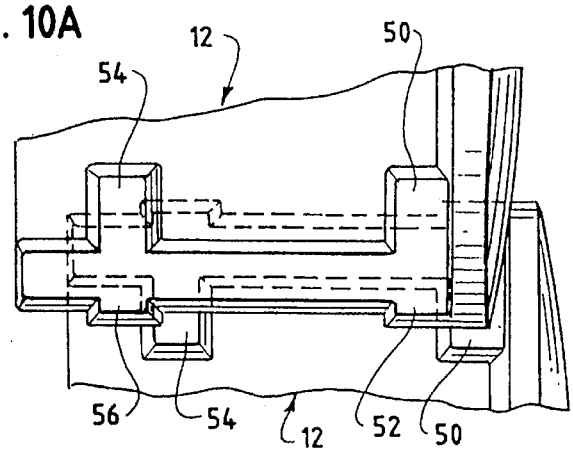
FIGS. 10A, 10B, 10C, and 10D are fragmentary, sectional views similar to FIG. 10 but showing alternative arrangements of the modules in a retaining wall.
Figure 10B:
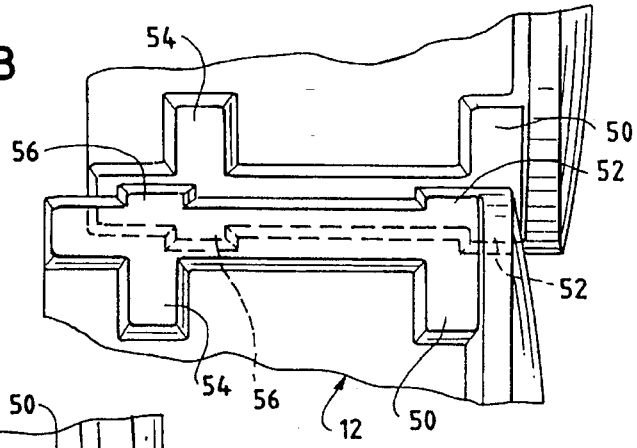
Figure 10C:
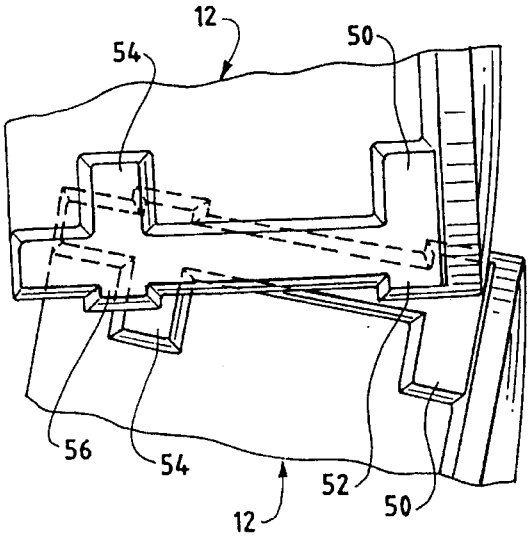
Figure 10D:
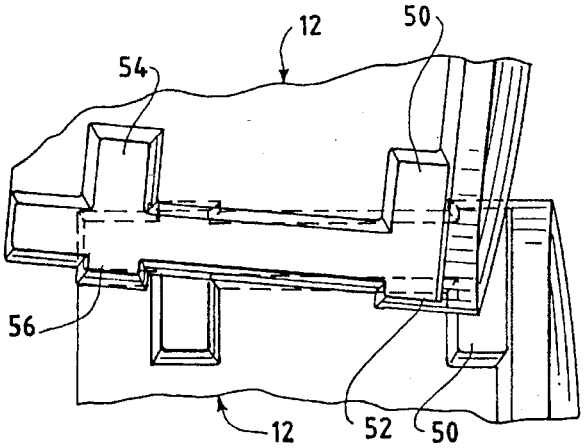

As shown in FIGS. 8, 9, and 10, the modules 12 are stacked so that the front and back ribs of at least one of the lateral walls 32 of each module 12 of each intermediate or lower course partly supports one of the modules of the next course above such intermediate or lower course. Because of the front and back ribs, the modules 12 can be so stacked even if the modules 12 are closer to one another in each course, as shown in FIG. 10A, or farther from one another, as shown FIG. 10B, or even if the modules 12 are arranged so that the retaining wall 10 has a generally convex face, as shown in FIG. 10C, or a generally concave face, as shown in FIG. 10D.

Because of the front ribs 50, 52, and the back ribs 54, 56, the columnar strength of the modules 12 is increased. The front and back ribs counter moments that tend to cause the lateral walls 32 to collapse under high columnar loads. Thus, the maximum height of the retaining wall 10 is increased significantly, as compared to the maximum height of a retaining wall built with otherwise similar modules without such front and back ribs, particularly if the retaining wall has a concave or convex face.

As shown in FIGS. 4, 6, and 8, each geogrid 20 is made from a woven, polymeric fabric of a type available commercially from Mirafi Company of Charlotte, N.C. Thus, at each module 12 anchoring such geogrid 20, such geogrid 20 is cut so as to have a rectangular tongue 62, which is wrapped over and under a rigid, tubular batten 64, such as a piece of polyvinyl chloride pipe, whereby such geogrid 20 can be positively and mechanically connected to the batten 64. Although it is shown that the tongue 62 is wrapped over and then below the batten 64, the tongue 62 may be alternatively wrapped under and above the batten 64.

Figure 7:
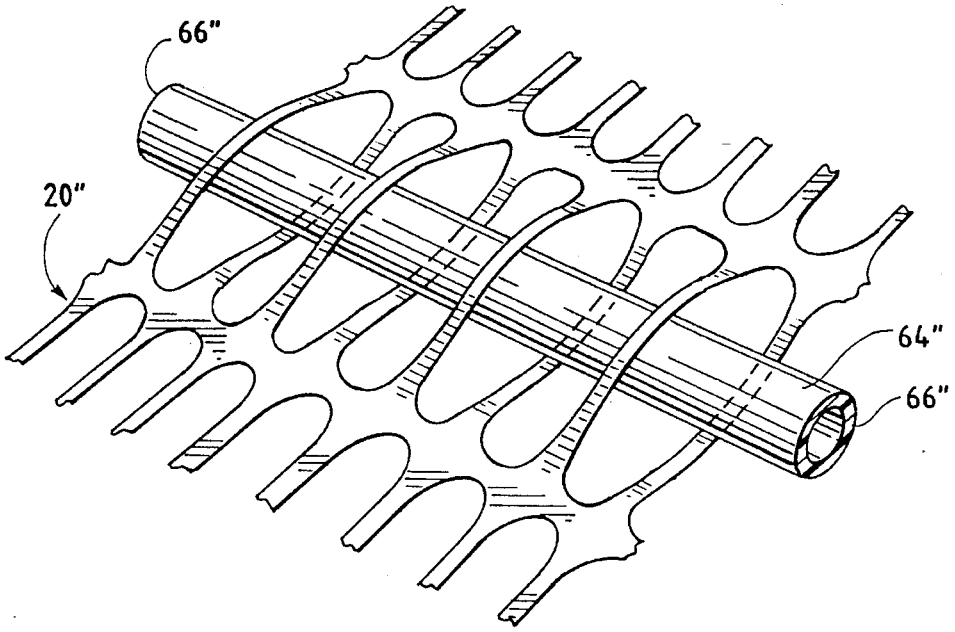
FIG. 7, on a slightly larger scale, is a fragmentary, perspective view of a geogrid of a second known type, through which such a batten is interlaced.

As shown in FIG. 7, in which double-primed reference numbers designate elements similar to elements designated by similar, unprimed reference numbers in other views, a geogrid 20" made from an oriented, apertured, polymeric sheet of a type available commercially from Tensar Structures, Inc. of Akron, N.Y., may be alternatively used. Thus, at each anchoring module 12 (none shown in FIG. 7), the geogrid 20" is cut so as to have a rectangular tongue 62", through which a batten 64" (which is similar to the batten 64) is interlaced so as to connect the geogrid positively and mechanically to the batten 64".

The rectangular tongue 62 (or 62") is narrower than the narrowest distance between the intermediate portions 58 of the lateral walls 32 of such anchoring module 12. The batten 64 (or 64") has a predetermined length more than the widest distance between the inwardly extending back ribs 54 of the lateral walls 32 of such module 12 but less than the narrowest distance between the intermediate portions 58 of the lateral walls 32 of such anchoring module 12. As connected to the rectangular tongue 62 (or 62"), the batten 64 (or 64") is positioned in such anchoring module 12 so that the opposite ends 66 (or 66") of the batten 64 (or 64") bear against the inwardly extending back ribs 54 of such anchoring module 12, between such ribs 54 thereof and the front wall 30 thereof, above the bottom wall 34 thereof.

As shown in FIG. 8, the batten 64 (or 64") is positioned so that the rectangular tongue 62 (or 62") bears against the bottom wall 34 of such anchoring module 12 where the geogrid tongue 62 (or 62") is connected to the batten 64 (or 64") and the geogrid 20 (or 20") is tensioned so that the batten 64 (or 64") is pulled against the inwardly extending back ribs 54 of such anchoring module 12, whereupon such anchoring module 12 is filled with earth 24. Thus, the batten 64 (or 64") is retained by and against the inwardly extending back ribs 54 of such anchoring module 12, and the geogrid tongue 62 (or 62") is retained by and against the bottom wall 34 of such anchoring module 12 and by the batten 64 (or 64").

Geogrids (not shown) of a known type made from metal mesh (e.g. steel mesh) can be alternatively employed where the geogrids 20 (or 20") described above are employed. Such metal mesh geogrids can be similarly anchored, via battens (not shown) similar to the battens 64 (or 64") and connected similarly to rectangular tongues of such metal mesh geogrids, to certain of the modules 12, in selected courses of the retaining wall 10.

As shown in FIGS. 4 and 5, a multiplicity of elongate tensioning members 80 are used as means for post-tensioning the retaining wall 10. Each member 80 is an elongate wire rod extending upwardly through the aperture 58 of the bottom wall 34 of an associated module 12 in the first or lowermost course, through the plantable space between two modules 12 of the second course, through the aperture 58 of the bottom wall 34 of an associated module 12 of the third course, through the plantable space between two modules 12 of the fourth course, and so on through the aperture 58 of the bottom wall 34 of an associated module 12 in the thirteenth or uppermost course. Rather than a wire rod, a polymeric (e.g., nylon) cable having suitable end fittings may be alternatively used.

Each member 80 has a lower end portion 82, which is threaded and which receives a threaded nut 84, over an annular washer 86, where the lower end portion 82 extends below the bottom wall 34 of the associated module 12 in the first or lowermost course. Each member 80 has an upper end portion 92, which is threaded and which receives a threaded nut 94, over an annular washer 96, where the lower end portion 92 extends above the bottom wall 34 of the associated module 12 in the thirteenth or uppermost course. The threaded nuts 94 of the respective members 80 are tightened, after the associated modules 12 in the thirteenth or uppermost course have been positioned, so as to post-tension the retaining wall 10.

In an alternative arrangement (not shown) the lower end portion 82 of each member 80 is not connected to one of the modules 12 in the lowermost course but is connected similarly to one of the concrete footings 14. In another alternative arrangement (not shown) the upper end portion 92 of each member 80 is not connected to one of the modules 12 in the uppermost course but is connected similarly to one of the modules 12 in a course below one or more courses including the uppermost course.

Because the front wall 30 of each module 12 of the retaining wall 10 has an upper portion 36 extending above the lateral walls 32 of such module 12, the modules 12 in a given course other than the first or lowermost course must be necessarily stepped back from the modules in the next course below the given course, by at least the thickness of the upper portions 36. Therefore, the retaining wall 10 must be necessarily sloped, as shown in FIG. 4.

Figure 11:
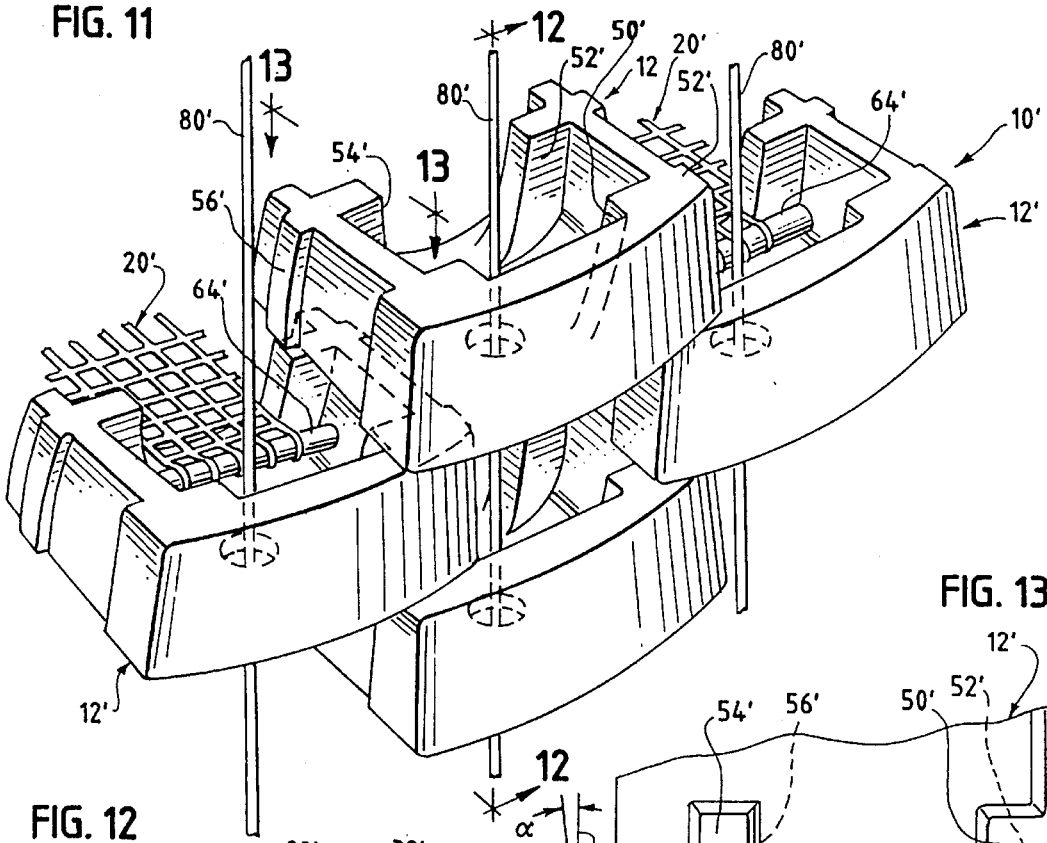
FIG. 11 is a fragmentary, perspective view of a retaining wall built from concrete modules, geogrids, and elongate tensioning members, except that earth and vegetation are omitted to simplify the view. The concrete modules conform to a second contemplated embodiment.
Figure 13:
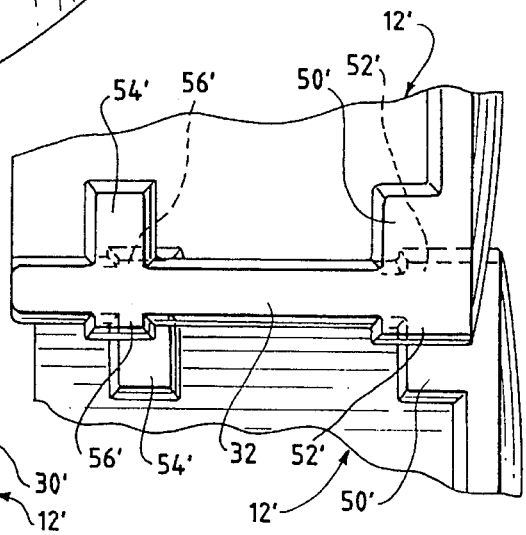
FIG. 13 is a sectional view taken along line 13—13 of FIG. 11, in a direction indicated by arrows.
Figure 12:
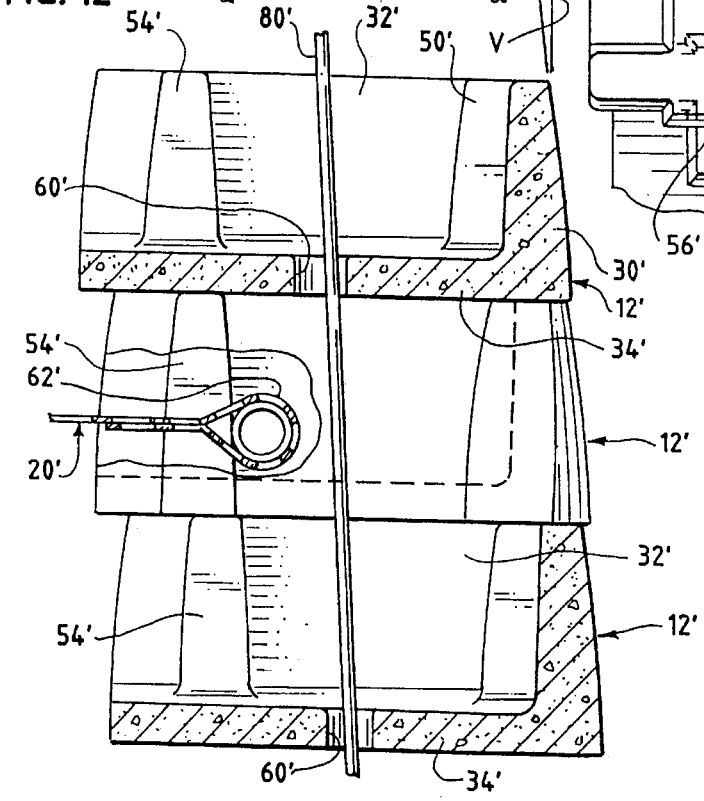
FIG. 12 is a sectional view taken along line 12—12 of FIG. 11, in a direction indicated by arrows.

However, as shown in FIGS. 11, 12, and 13, in which primed reference numbers designate elements similar to elements designated by similar, unprimed reference numbers in other views, each module 12' of a retaining wall 10' may be alternatively made so that the front wall 30' of such module 12' does not have an upper portion extending above the lateral walls 32' of such module 12'. Rather, the front wall 30' and the lateral walls 32' including the front ribs 50', 52', and the back ribs 54', 56', have coplanar top surfaces, as well as coplanar bottom surfaces. The retaining wall 10' is post-tensioned by a plurality of elongate tensioning members 80' (which are similar to the elongate tensioning members 80) and has geogrids 20' (one shown) having rectangular tongues 62' anchored to certain modules 12' of the retaining wall 10' via battens 64' (similar to the batten 64) and anchored in fill (not shown) behind the retaining wall 10'. The elongate tensioning members 80' extend through the central apertures 60' in the bottom walls 34 of the modules 12 in every other course. As post-tensioned and anchored, the retaining wall 10' may be nearly vertical, as shown, or truly vertical.

Various modifications may be made in the concrete modules illustrated and described herein or in the retaining walls illustrated and described herein without departing from the scope and spirit of this invention.

I claim:

1. A concrete module useful in making a retaining wall, the concrete module having unitary walls including a front wall and two lateral walls, the front and lateral walls being upright, the front wall extending above the lateral walls, each lateral wall having a front edge adjoining the front wall, each lateral wall having an upright, inwardly extending front rib adjoining the front wall along the front edge of said lateral wall, the front ribs being spaced laterally from each other so as to define a gap between the front ribs.

2. The concrete module of claim 1 wherein each lateral wall has an upright, outwardly extending front rib adjoining the front wall and aligned laterally with the upright, inwardly extending front rib of said lateral wall.

3. The concrete module of claim 1 having an additional wall unitary with the front and lateral walls.

4. The concrete module of claim 3 wherein the additional wall is a bottom wall.

5. A concrete module useful in making a retaining wall, the concrete module having unitary walls including a front wall and two lateral walls, the front and lateral walls being upright, the front wall extending above the lateral walls, each lateral wall having a front edge adjoining the front wall, each lateral wall having an upright, inwardly extending front rib adjoining the front wall along the front edge of said lateral wall, the concrete module having an additional wall unitary with the front and lateral walls, the additional wall being a bottom wall, wherein the bottom wall has an aperture to accommodate an elongate tensioning member extending through the aperture.

6. The concrete module of claim 5 wherein the front, lateral, and bottom walls have coplanar bottom surfaces.

7. A concrete module useful in making a retaining wall, the module having unitary walls including a front wall, two lateral walls, and a bottom wall, the front and lateral walls being upright, each lateral wall having a front edge adjoining the front wall, a back edge spaced from the front edge, and an upright, inwardly extending back rib near the back edge, the inwardly extending back rib being spaced from the back edge but being substantially closer to the back edge than to the front edge, wherein the inwardly extending back ribs of the lateral walls are spaced laterally from each other.

8. The concrete module of claim 7 wherein each lateral wall has an upright, outwardly extending back rib aligned laterally with the upright, inwardly extending back rib of said lateral wall.

9. A concrete module useful in making a retaining wall, the module having unitary walls including a front wall, two lateral walls, and a bottom wall, the front and lateral walls being upright, each lateral wall having a front edge adjoining the front wall, a back edge spaced back from the front edge, and an upright, inwardly extending back rib near the back edge, and an upright, outwardly extending back rib aligned laterally with the upright, inwardly extending back rib of said lateral wall.

10. The concrete module of claim 9 wherein the front, lateral, and bottom walls have coplanar bottom surfaces.

11. A concrete module useful in making a retaining wall, the module having unitary walls including a front wall, two lateral walls, and a bottom wall, the front and lateral walls being upright, each lateral wall having a front edge adjoining the front wall, a back edge spaced back from the front edge, an upright, inwardly extending front rib adjoining the front wall along the front edge, an upright, outwardly extending front rib aligned laterally with the upright, inwardly extending front rib, an upright, inwardly extending back rib near the back edge, and an upright, outwardly extending back rib, the bottom wall having an aperture to accommodate an elongate tensioning member extending through the aperture, the front, lateral, and bottom walls having coplanar bottom surfaces.

12. The concrete module of claim 11 wherein the front wall extends above the lateral walls.

13. In a retaining wall comprising concrete modules stacked in multiple courses including a lower course, at least one intermediate course, and an upper course, each course having modules arranged so that modules of each course straddle modules of the next course above or below said course and so that modules of each course are spaced laterally from one another to provide plantable spaces between modules of said course, an improvement wherein the retaining wall comprises means for post-tensioning the retaining wall, the post-tensioning means including an elongate tensioning member extending between two of the modules in at least one intermediate course, to one of the modules in the upper course.

14. The improvement of claim 13 wherein the elongate member extends from one of the modules in the lower course, between two of the modules in at least one intermediate course, to one of the modules in the upper course.

15. The improvement of claim 14 wherein the post-tensioning means includes a plurality of such elongate tensioning members, each extending from one of the modules in the lower course, between two of the modules in every other one of the intermediate courses, to one of the modules in the upper course.

16. In a retaining wall comprising concrete modules stacked in multiple courses including a lower course, at least one intermediate course, and an upper course, each course having modules arranged so that modules of each course straddle modules of the next course above or below said course, an improvement wherein the retaining wall comprises means for post-tensioning the retaining wall, the post-tensioning means including an elongate tensioning member extending from one of the modules in the lower course, between two of the modules in at least one of the intermediate courses, to one of the modules in the upper course, wherein each module has unitary walls including a front wall, two lateral walls, and a bottom wall, the front and lateral walls being upright, the bottom wall having an aperture to accommodate such an elongate tensioning member, each elongate tensioning member extending through the aperture of the bottom wall of one of the modules of the upper course, between two of the modules in at least one of the intermediate courses, through the aperture of one of the modules of a course below the at least one of the intermediate courses.

17. The improvement of claim 16 wherein the front wall of each module extends above the lateral walls thereof, wherein each lateral wall of each module has a front edge adjoining the front wall thereof and an upright, inwardly extending front rib adjoining the front wall thereof along the front edge of said lateral wall, the modules being stacked so that the front rib of at least one of the lateral walls of each module of each intermediate or lower course partly supports one of the modules of the next course above said intermediate or lower course.

18. The improvement of claim 16 wherein the front wall of each module extends above the lateral walls thereof, wherein each lateral wall of each module has a front edge adjoining the front wall thereof, an upright, inwardly extending front rib adjoining the front wall thereof along the front edge of said lateral wall, and an upright, outwardly extending front rib adjoining the front wall thereof and aligned laterally with the upright, inwardly extending front rib of said lateral wall, the modules being stacked so that the front ribs of at least one of the lateral walls of each module of each intermediate or lower course partly supports one of the modules of the next course above said intermediate or lower course.

19. In a retaining wall comprising concrete modules stacked in multiple courses including an upper course, at least one intermediate course, and a lower course, each course having modules spaced laterally from one another so that modules of each course straddle modules of the next course above or below said course, each module having unitary walls including a front wall, two lateral walls, and a bottom wall, the front and lateral wails being upright, each lateral wail having a front edge adjoining the front wall and a back edge spaced back from the front edge, the front wall extending above the lateral walls, an improvement wherein each lateral wall has an upright, inwardly extending front rib adjoining the front wall along the front edge of said lateral wall, the front ribs being spaced laterally from each other so as to define a gap between the front ribs, and wherein the modules are stacked so that the front rib of at least one of the lateral walls of each module of each or lower intermediate course partly supports one of the modules of the next course above said intermediate or lower course.

20. The improvement of claim 19 wherein each lateral wall of each module has a back edge spaced back from the front edge of said lateral wall and an upright, inwardly extending back rib near the back edge of said lateral wall and wherein the modules are stacked so that the front and back ribs of at least one of the lateral walls of each module of each intermediate or lower course partly support one of the modules of the course above said intermediate or lower course.

21. The improvement of claim 20 wherein the retaining wall further comprises a geogrid and means including a batten for anchoring the geogrid to a selected module of the retaining wall, the batten being connected to the geogrid and having two opposite ends bearing against the inwardly extending back ribs of the selected module, between the inwardly extending back ribs hereof and the front wall thereof, above the bottom wall thereof.

22. The improvement of claim 19 wherein each lateral wall of each module has a back edge spaced back from the front edge of said lateral wall, an upright, outwardly extending front rib adjoining the front wall of said module and aligned laterally with the upright, inwardly extending front rib of said lateral wall, an upright, inwardly extending back rib near the back edge of said lateral wall, and an upright, outwardly extending back rib aligned laterally with the upright, inwardly extending back rib of said lateral wall and wherein the modules are stacked so that the front and back ribs of at least one of the lateral walls of each module of each intermediate or lower course partly support one of the modules of the next course above said intermediate or lower course.

23. The improvement of claim 22 wherein the retaining wall further comprises a geogrid and means including a batten for anchoring the geogrid to a selected module of the retaining wall, the batten being connected to the geogrid and having two opposite ends retained by the inwardly extending back ribs of the selected module, between the inwardly, extending back ribs hereof and the front wall thereof, above the bottom wall thereof.

24. In a retaining wail comprising concrete modules stacked in multiple courses including an upper course, at least one intermediate course, and a lower course, each course having modules spaced laterally from one another so that modules of each course straddle modules of the next course above or below said course, each module having an open top and having unitary walls including a front wall, two lateral walls, and a bottom wall, the front and lateral walls being upright, each lateral wall having a front edge adjoining the front wall and a back edge spaced back from the front edge, an improvement wherein each lateral wall of each module has an upright, inwardly extending back rib near the back edge of said lateral wall, the modules being stacked so that the back rib of at least one of the lateral walls of each module of each intermediate or lower course partly supports one of the modules of the course above said intermediate or lower course, and wherein the retaining wall further comprises a geogrid and means including a batten for anchoring the geogrid to a selected module of the retaining wall, the batten being connected positively and mechanically to the geogrid and having two opposite ends bearing against the back ribs of the lateral walls of the selected module, between the back ribs thereof and the front wall of the selected module, above the bottom wail of the selected module.

* * * * *

UNITED STATES PATENT AND TRADEMARK OFFICE

CERTIFICATE OF CORRECTION

PATENT NO. : 5,564,865

DATED : October 15, 1996

INVENTOR(S) : Jan E. Jansson

It is certified that error appears in the above-indentified patent and that said Letters Patent is hereby corrected as shown below:

Column 7, line 62, (Claim 9) before the period ending the claim, insert --, wherein the bottom wall has an aperture to accommodate an elongate tensioning member extending through the aperture--.

Signed and Sealed this

Twenty-first Day of January, 1997

*Attest:*

Bruce Lehman

BRUCE LEHMAN

*Attesting Officer*

*Commissioner of Patents and Trademarks*